United States Patent [19]

Farmer et al.

[11] 4,426,869

[45] Jan. 24, 1984

[54] RADIAL INFEED THREAD ROLL ATTACHMENT

[75] Inventors: Robert M. Farmer, Marlboro; Brian R. Faucher, Paxton, both of Mass.

[73] Assignee: Litton Industrial Products, Inc., Holden, Mass.

[21] Appl. No.: 383,477

[22] Filed: Jun. 1, 1982

[51] Int. Cl.[3] ..... B21H 3/04

[52] U.S. Cl. ..... 72/104; 72/108; 72/452; 74/107; 294/116

[58] Field of Search ..... 72/104, 108, 393, 452; 74/107; 294/106, 116

[56] References Cited

U.S. PATENT DOCUMENTS 2,654,632 10/1953 Herbert ..... 294/116
4,336,703 6/1982 Thomas et al. ..... 72/104

FOREIGN PATENT DOCUMENTS 770790 10/1980 U.S.S.R. ..... 294/106

*Primary Examiner*—Francis S. Husar
*Assistant Examiner*—William E. Terrell
*Attorney, Agent, or Firm*—Spencer T. Smith

[57] ABSTRACT

A radial infeed thread roll attachment comprising a pair of jaw elements each having a thread roll mounted at one end and a roller secured on the other end, a housing, pivotally mounting the jaw elements in opposed relation thereon, a cam assembly mounted on the housing and having an inner portion having a wedge-shaped cam element at one end and a threaded member at the other end and an outer portion, a spring for forcefully maintaining the rollers in engagement with the cam element for preventing the rotation of the inner portion when the outer portion is rotated whereby rotation of the outer portion will result in the axial displacement of the inner portion relative to the outer portion, the outer portion having an outer axially fixed element and an inner axially displaceable element threadedly related to the inner portion threaded member, the outer element having an axially extending keyway and the inner element having an axially extending key, a hydraulic cylinder with an air-on-oil hydraulic booster or other suitable hydraulic source, the cylinder being secured to the inner element for axially displacing the inner element and the threadedly related inner portion a fixed distance between a retracted and an advanced position with no rotational displacement therebetween.

3 Claims, 3 Drawing Figures

Fig_2
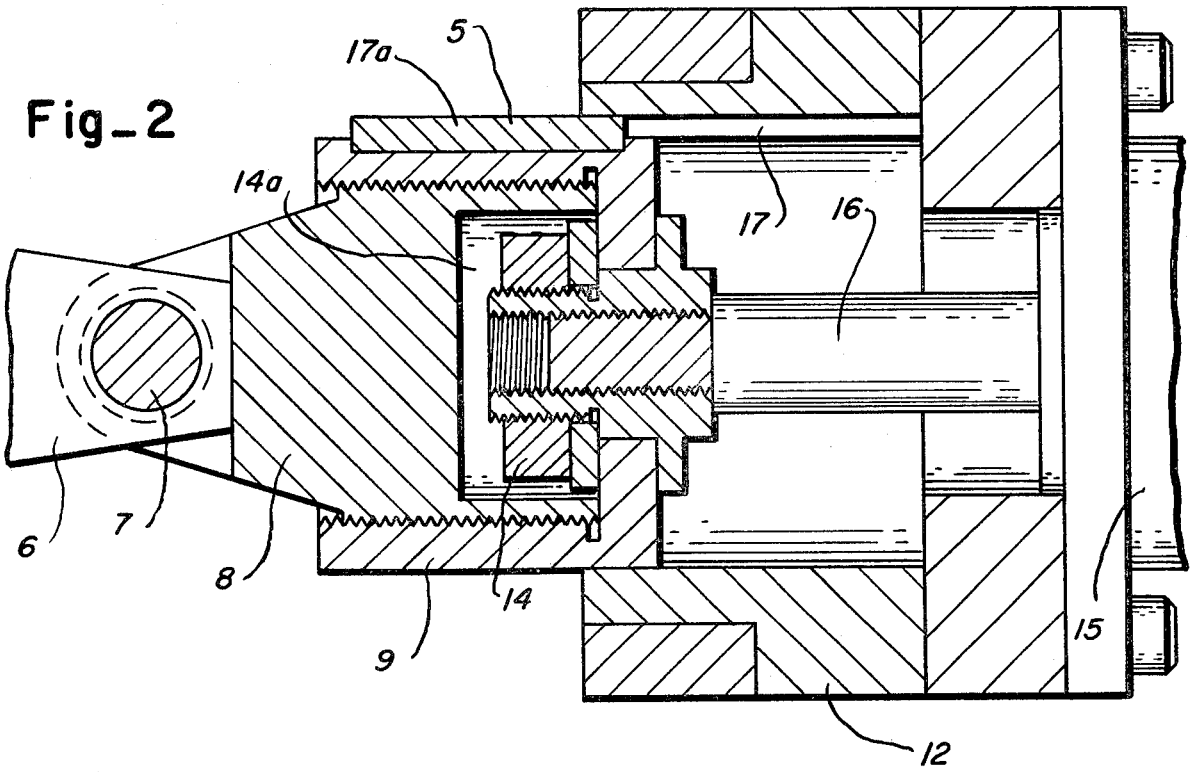
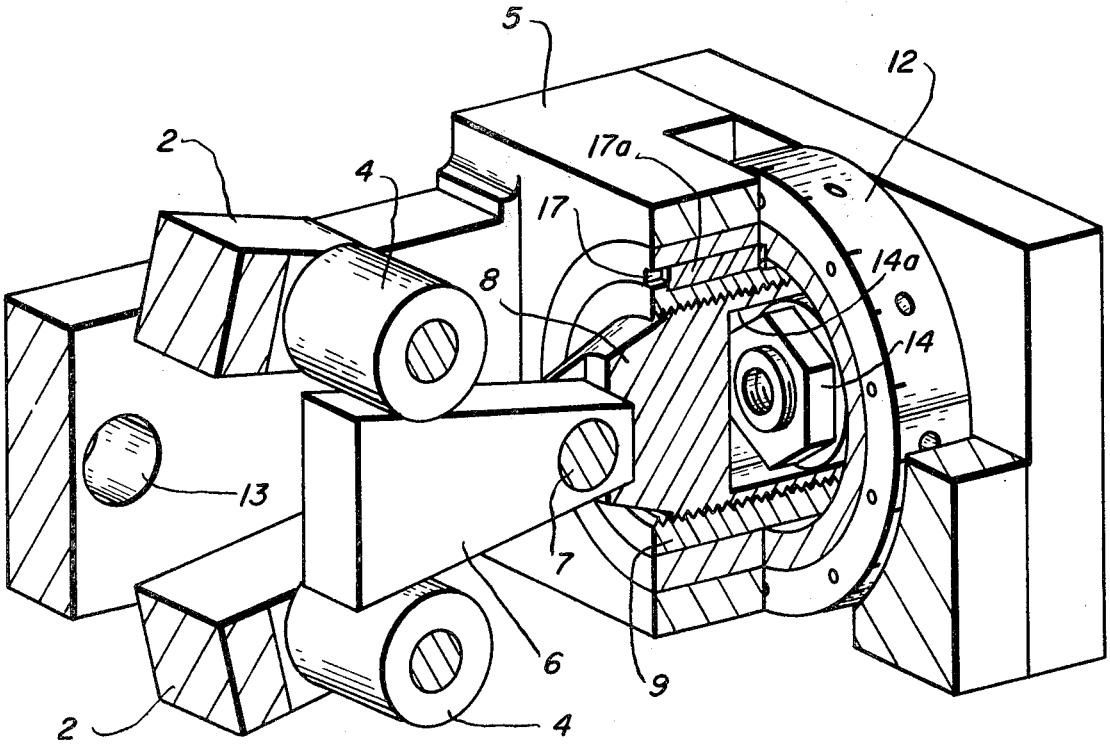
Fig_3

RADIAL INFEED THREAD ROLL ATTACHMENT

BACKGROUND OF THE INVENTION

Radial infeed thread rolling offers the advantage of balanced loading of the work and minimizes spindle loads. It also allows rolling at greater distances from the work holding collet. Many radial infeed thread rolling attachments accommodate limited ranges of stock sizes. Other thread rolling attachments expand their stock size range through the use of a large number of adjustment cams. There exists a need for an expanded range, continuously adjustable thread rolling attachment which employs a limited number of cams and provides an actuation system with a stiffness and penetration control consistent with the roll form process.

SUMMARY AND OBJECTS OF THE INVENTION

According to the invention, a radial infeed thread roll attachment is comprised of a pair of pivoting, jaw mounted roll form dies which are operated by a high pressure hydraulic cylinder and which can be adjusted during machine operation to accommodate various stock sizes and to change roll depth.

It is, therefore, an object of the invention to provide a radial infeed thread roll attachment.

It is a further object of the invention to provide a thread rolling attachment which by virtue of the constant length of stroke of its actuating cylinder, and through the use of a small family of easily changed wedges or cams, is capable of rolling a wide range of thread sizes.

Another object of the invention is to provide a thread rolling attachment which is continuously adjustable throughout the range of each of the cams.

It is also an object of the invention to provide a thread rolling attachment which can be adjusted while its host machine is operating, adjustments being made between actual thread rolling cyles.

A further object of the invention is to provide a thread rolling attachment which is actuated by means of a high pressure hydraulic cylinder.

Other objects and advantages of the present invention will become apparent from the following portion of the specification and from the accompanying drawings which illustrate, in accordance with the mandate of the patent statutes, a presently preferred embodiment incorporating the principles of the invention.

BRIEF DESCRIPTION OF THE DRAWINGS

FIG. 2 is a sectional view of the cam assembly.

FIG. 3 is a perspective sectional view of the cam assembly.

DESCRIPTION OF THE PREFERRED EMBODIMEMT

Figure 1:
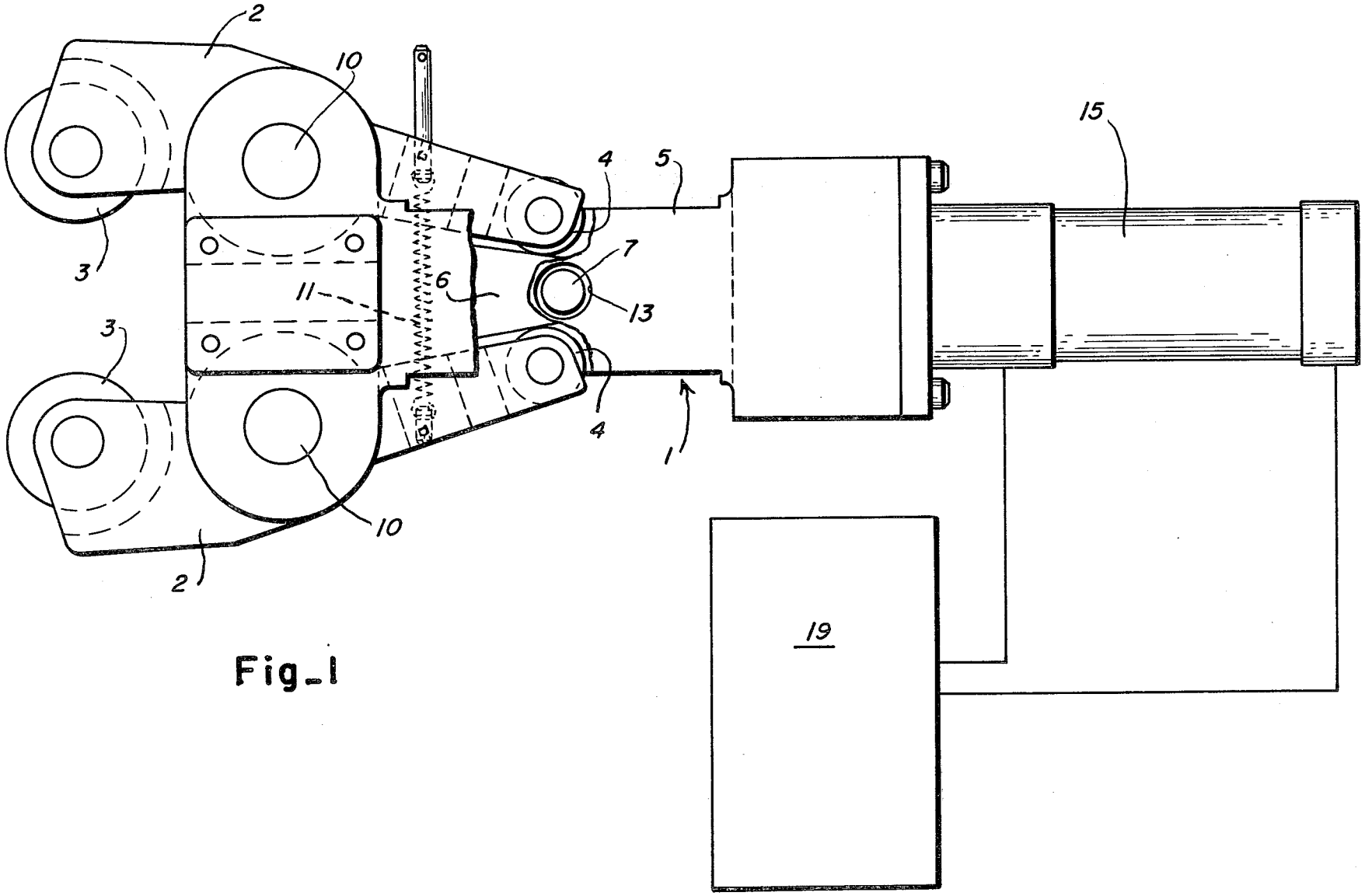
FIG. 1 is an outline drawing of the radial infeed thread roll attachment.

As illustrated in FIG. 1, the radial infeed thread roll attachment 1 is comprised of roll form dies 3 mounted to the jaws 2 which rotate about pivots 10. The jaws 2 are caused to rotate and functionally activate the roll form dies 3 by the axial motion of the wedge-shaped cam 6.

Referring now to FIGS. 2 and 3, the cam 6 is part of a cam assembly which is made up of the cam 6, cam clevis pin 7, cam assembly inner portion 8, and cam assembly outer portion 9, all of which are suitably contained in the housing 5. The cam assembly inner portion 8 is attached to the power cylinder 15 through the power cylinder output shaft 16 and secured by means of the power cylinder attachment nut 14. The attachment nut 14 is completely enclosed in the chamber **14*a* which is created by the assembly of the inner portion 8 and the outer portion comprised of an inner axially displaceable element 9 and an outer axially fixed element 12. The cam assembly inner portion is also attached to the cam 6 through the cam clevis pin 7. Axial stroking of the power cylinder causes the cam 6, acting through the rollers 4, to rotate the jaws 2 about the jaw pivots 10. The jaw return spring 11 opens the jaws as the cam 6 withdraws from the rollers 4. The jaw return spring, acting through the rollers 4, also prevents rotation of the cam assembly inner portion when rotating the cam assembly adjusting ring 12**.

Axial adjustment of cam 6, which determines the closed position of the rollers 4 after stroking the power cylinder 15, is made by means of the cam assembly adjusting ring 12. The keyway 17 of ring 12 through key **17*a* interconnects the ring to the cam assembly outer portion 9. Rotational displacement of the cam assembly outer portion 9 by means of the adjusting ring 12 axially displaces the inner portion 8 relative to the outer portion 9**.

The power cylinder 15 axially displaces the cam assembly from an advanced position (illustrated in FIG. 2) to a retracted position (illustrated in FIG. 3) without imparting any rotational displacement to either the outer portion 9 or the inner portion 8. The power cylinder 15 axially displaces the cam assembly a distance equal to the full stroke of the power cylinder over the complete range of size adjustment effected by the cam assembly. The power cylinder 15 is hydraulically powered, and in order to create a thread rolling attachment whose stiffness and penetration control is consistent with the thread rolling process, the power cylinder is furnished hydraulic fluid at about 1200 to 1300 psi from an air-on-oil hydraulic booster 19, or from other suitable hydraulic means.

The cam 6 can be readily removed and replaced to provide for other ranges of stock sizes by aligning cam clevis pin 7 with the aperture 13 in the housing 5 and removing the pin 7 and replacing the cam 6 and pin 7.

What is claimed is:

1. A radial infeed thread roll attachment comprising a pair of jaw elements each having means for mounting a thread roll at one end and a roller secured on the other end, a housing, means for pivotally mounting said jaw elements in opposed relation on said housing, a cam assembly having an inner portion having a flat wedge-shaped cam element at one end and a threaded member at the other end and an outer portion, means for mounting said cam assembly on said housing, spring means for forcefully maintaining said rollers in engagement with said cam element for preventing the rotation of said inner portion when said outer portion is rotated whereby rotation of said outer portion will result in the axial displacement of said inner portion relative to said outer portion, said outer portion having an outer axially fixed element and an inner axially displaceable element threadedly related to said inner portion threaded member, said outer element having an axially extending keyway and said inner element having an axially extending key, and cylinder means including a hydraulic cylinder with an air-on-oil hydraulic booster, means for securing said cylinder means to said inner element for axially displacing said inner element and said threadedly related inner portion a fixed distance between a retracted and an advanced position with no rotational displacement therebetween.

2. A radial infeed thread roll attachment according to claim 1, where said cam assembly allows an actuating hydraulic cylinder to maintain its full stroke over the entire size adjustment range of said cam assembly.

3. A radial infeed thread roll attachment according to claim 1, wherein said cam assembly inner portion threaded member includes a chamber for receiving a portion of said securing means.

* * * * *